United States Patent [19]

Sigl et al.

[11] 3,982,325

[45] Sept. 28, 1976

[54] METHOD OF SOLVENT DRYING

[75] Inventors: Wayne C. Sigl, Black Creek; Frederick O. Lassen, Neenah, both of Wis.

[73] Assignee: Kimberly-Clark Corporation, Neenah, Wis.

[22] Filed: Apr. 30, 1975

[21] Appl. No.: 573,065

[52] U.S. Cl. ..... 34/9; 34/69

[51] Int. Cl.[2] ..... F26B 3/00

[58] Field of Search ..... 34/9, 69

[56] References Cited

UNITED STATES PATENTS

| | | | |
|---|---|---|---|
| 2,454,941 | 11/1948 | Pierce et al. | 34/9 X |
| 3,239,946 | 3/1966 | Forkner | 34/69 |
| 3,791,044 | 2/1974 | Busker et al. | 34/9 |

*Primary Examiner*—John J. Camby

*Attorney, Agent, or Firm*—Daniel J. Hanlon, Jr.; William D. Herrick; Raymond J. Miller

[57] ABSTRACT

Solvent-drying, particularly of water-wetted materials, is accomplished through the use of specific azeotropic mixed-solvent systems. The azeotropic systems used in the method of the invention are those which form two or more separate layers, in which the water distribution equilibrium favors the concentration of water or other liquid being removed in one layer over the other. The water or other liquid, therefore, concentrates in one layer facilitating removal by separation of the layers. Drying of the material takes place in the other layer which maintains a constant liquid concentration sufficiently low so as to produce a substantially dried product. Temperature control of the solvent bath and separator contents results in a single-layer drying bath and facilitates separation in a preferred embodiment.

7 Claims, 3 Drawing Figures

METHOD OF SOLVENT DRYING

BACKGROUND OF THE INVENTION

1. Field of the Invention

In many processes which have one or more steps requiring the distribution of fibrous or particulate material it has proven convenient and economical to use a liquid vehicle, particularly water, for this distribution. Subsequent removal of the liquid vehicle (drying) in such cases becomes an important consideration. While drying usually can be accomplished simply by exposure to the atmosphere and evaporation, speed of operation and other economic factors in most cases dictate the use of accelerated drying techniques. Examples of these techniques are well-known and include contact with a hot surface such as a steam heated dryer drum, contact with a gas stream which may be heated such as air, and contact with a solvent in which the liquid to be removed is highly soluble, causing it to be drawn from the material being dried and concentrated into the solvent.

Since solvent-drying is usually more expensive due to additional chemical costs and often capital costs for solvent recovery equipment, its use is primarily limited to processes which require its unique advantages. Contact with a hot drum in most cases results in an ironing out or flattening of the dried material, and air drying of fibrous materials frequently imparts a harsh stiffness to the material. Solvent-drying, on the other hand, can result in a soft, relatively uncompressed, dried product.

2. Description of the Prior Art

In conventional solvent-drying steps, the material to be dried is usually drawn in web or fiber form through a solvent bath. The liquid to be removed is exchanged in the bath leaving the web or filament drier as it emerges from the solvent bath. In some cases it has proven desirable to employ multiple solvent baths to increase the rate of liquid removal or where different solvents are required to remove more than one liquid, for example. In copending and co-assigned U.S. patent application Ser. No. 402,311 to Frederick O. Lassen entitled "Filaments of Chemically Modified Cellulose Fibers, Method of Making Such Filaments and Webs and Products Formed Therefrom" there is disclosed a solvent-drying process wherein multiple solvent baths are utilized with the result that solvent renewal requirements can be substantially reduced.

It is a characteristic of solvent-drying steps that periodic changing of the solvent bath is required. The evaporation of the solvent combined with the build-up of the liquid being renewed will eventually render the drying properties of the bath ineffective. In most cases it is necessary to separate the liquid removed from the solvent in order that the solvent can be reused. This presents a problem of substantial economic importance in virtually all processes utilizing a solvent-drying step. The entire bath volume must be treated by distillation or other separation techniques which inherently causes a considerable loss of solvent. It can be readily seen, that a significant amount of the expense of solvent-drying is occasioned by the solvent regeneration or reconcentration step. The present invention is directed at a method of solvent-drying which greatly facilitates solvent renewal and reduces the solvent losses.

SUMMARY OF THE INVENTION

In accordance with the present invention, a solvent or solvent mixture is used as the drying medium which forms layers one of which favors the concentration of the liquid being removed. More specifically, the solvent mixture is one that forms two or more immiscible layers, one of which has an equilibrium concentration substantially richer in the liquid being removed than the one or more others. When contacted with the solvent medium in accordance with the invention, the liquid being removed is concentrated in the layer of the solvent mixture in which it is richest with a minimum depletion of the solvent medium. In treating the solvent, it is therefore necessary only to withdraw the liquid-rich layer and purify the solvent by azeotropic distillation to an extent that it can be returned to the drying bath. Preferably, the liquid-rich layer comprises only a minor portion by volume of the solvent mixture, and drying of the material takes place in a different layer.

DESCRIPTION OF THE PREFERRED EMBODIMENTS

While the invention will be described in connection with preferred embodiments, it will be understood that it is not intended to limit the invention to those embodiments. On the contrary, it is intended to cover all alternatives, modifications, and equivalents as may be included within the spirit and the broad scope of the invention as defined by the appended claims.

The azeotrope-forming mixtures which can be used in accordance with the process of the invention will depend on a number of factors including the specific liquid to be removed, the amount to be removed, and the desired speed of the drying step. When an azeotrope-forming mixture includes two solvents, it is only essential that they form immiscible layers, one of which includes a major portion of the liquid being removed and that the other layer be effective in removing the liquid from the material being dried. As used herein the term "azeotrope" refers generally to the mixed solvent systems that distill universally at a constant composition at a given temperature and pressure. The layer that tends to be rich in the liquid being removed preferably is maintained as a minor portion of the total volume of the solvent bath. The liquid to be removed will be distributed into a solvent drying system, the partition coefficients of which favor the concentration of this liquid in one of the separate, immiscible layers. Examples of mixtures which favor such distribution include the following: butanol-water, methanol-chloroform-water, and 2,3-dichloropropanol-water. Others will be apparent to those skilled in this art.

Figure 1:
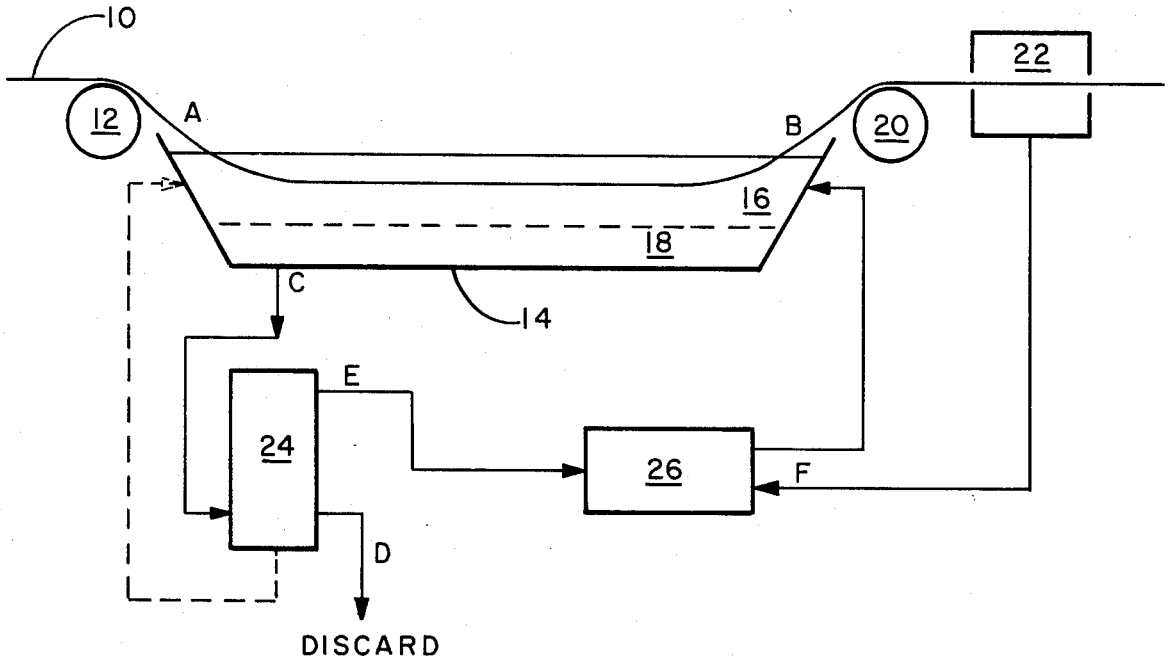
FIG. 1 illustrates schematically an embodiment of the method of the invention for a two layer system with drying in the top layer.

Turning to FIG. 1, a preferred embodiment of the method of the invention will be described. Wet web 10 travels over guide roll 12 into tank 14 which contains the solvent drying medium divided into layers 16 and 18. Layer 18 is preferably similar in volume and richer in the liquid being removed than is layer 16. Web 10 preferably contacts only layer 16 and is drawn over guide roll 20 out of the tank 14. If web 10 is so light as to float, means may be provided such as guide bars (not shown) to maintain immersion in layer 16. If desired, the web may be air dried in chamber 22 before being wound or further processed.

Solvent renewal takes place by withdrawing the liquid rich layer 18 from bath 14 and directing it to distillation column 24. Preferably this layer undergoes azeotropic distillation producing a distillate which proportionally is significantly lower in the liquid than is the original liquid-rich layer of the bath being distilled. Where condensation takes place in the column 24, the condensate may be returned to the bath as indicated by the dashed arrow. Alternatively, the vapors may be condensed at 26 for collection, and the solvent-rich distillate can be returned to tank 14. In certain cases, if economically feasible, a mechanical separation step can be carried out between condensation 26 and bath 14 to further purify the solvent. Additionally, in some cases it may be practical to direct the exhaust from air drying chamber 22 to condenser 26 to increase solvent recovery.

Thus a virtually closed system is presented that requires treatment of only a fraction of the solvent volume. The layer 16 will remain relatively free of the liquid being removed as this liquid will transfer to layer 18.

Figure 2:
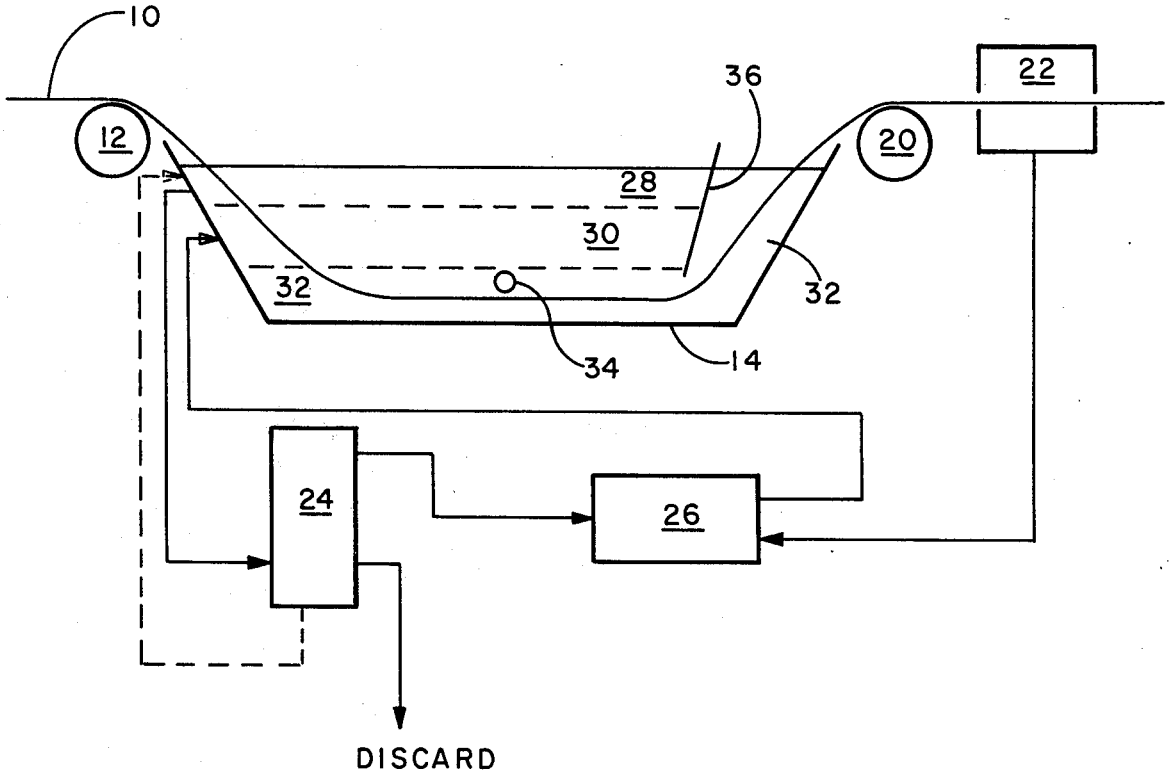
FIG. 2 schematically illustrates an alternative embodiment utilizing a three layer system with drying in the bottom layer.

FIG. 2 illustrates a similar arrangement for use in a solvent system where the liquid-rich layer forms on top. In this case the solvent system is shown as separating into three layers 28, 30, and 32 in which the first two of are relatively liquid-rich and the bottom layer solvent rich. The web 10 is drawn into the lower solvent rich layer 32 under idler roll 34, and baffle 36 prevents contact between web 10 and the liquid-rich upper layers 28 and 30 as the web is withdrawn.

Solvent renewal is as described with respect to FIG. 1 except that liquid rich composition is drawn from the top of tank 14.

Figure 3:
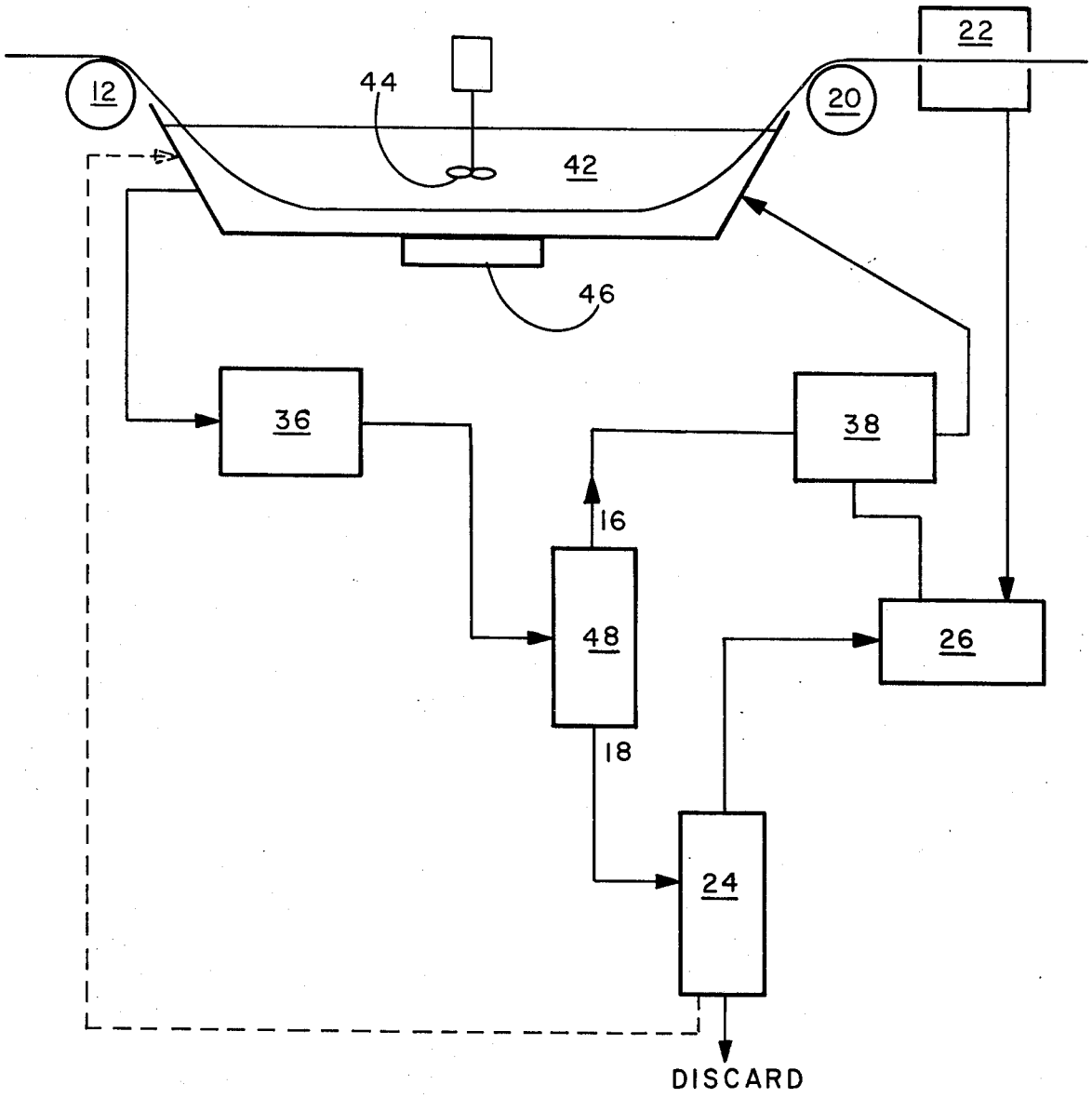
FIG. 3 illustrates schematically a third embodiment providing for temperature control of the bath and separator contents.

FIG. 3 illustrates a third embodiment wherein the bath contents 42 are directed through cooler 36 and to separator 24 and heater 38 before returning to bath 42. Bath 42 is provided with stirrer 44 and heater 46. In this manner separation takes place only in the separator and a single layer drying bath is maintained under desired temperature conditions.

EXAMPLE 1

An arrangement corresponding to the schematic diagram of FIG. 1 was assembled for the binary azeotrope-forming solvent system including butanol and water. A solution containing 45 percent water and 55 percent butanol (w/w) was placed in a separatory funnel where it formed a two layer system wheren the bottom layer was about 28–29 percent of the total volume and was composed of 7.7 percent butanol and 92.3 percent water, (w/w). Twenty milliliters of distilled water were added, and the layers were allowed to separate. A slight decrease in the volume of the upper layer and a large volume increaase in the lower layer were observed demonstrating that the drying process requires only a minor fraction of the total solvent composition. The lower, water rich layer was removed and distilled at a constant temperature (about 93°C) which was lower than the boiling point of either of the components water (BP 100°C) and butanol (BP 117°C). The condensate was returned to the separatory funnel, and the volume of the remaining water measured after cooling. Volumes in the funnel returned to their original values, and approximately 20 milliliters of water remained in the still.

The amount of water added to the system was concentrated in the lower layer and remained in the still after azeotropic distillation of the butanol with the result that the solvent bath composition was unchanged after completion of the cycle.

EXAMPLE 2

The process of the present invention was applied to dewater webs of phosphorylated cellulose fibers produced in accordance with Example 1 of the abovementioned Lassen application Ser. No. 402,311. Thus, Northern Spruce pulpboards (air dried) were soaked for one-half hour at 70°C in a solution of 50 percent urea, 32 percent orthophosphoric acid and 18 percent water by weight for a solution pickup of 138 percent by weight based on airdried pulp weight. They were then cured for 2 hours at about 180° to 190°C in a forced draft oven. Following a water wash, the fibers were treated for 1 hour with 3.7 percent HCL (w/w) at 60°–70°C. Following a second water wash, the fibers were soaked in 5–10 percent sodium carbonate (w/w) for one-half hour at room temperature. Then following a third water wash, the fibers were refined in a standardized Valley beater, being hydrorefined for 30 minutes and mechanically refined for 3 minutes with 5 pounds pressure on the beater blade. Following adjustment of the pH to 7.5 with dilute hydrochloric acid, the unbound interfiber water was removed from the refined fibers by centrifugation at approximately 37,000 g. using a Sharpless Model M-41-24 ultra-centrifuge. The resulting swollen fibrous mass contained about 96 percent water by weight and was extruded through a 20 gauge (I.D. about 0.022 inch) syringe needle into a solvent bath. In accordance with the present invention and as illustrated schematically in FIG. 2, the solvent bath comprised a tertiary azeotropic mixture, chloroform-methanol-water. In this system, the water partitioned between the two layers of chloroform and methanol wherein the water content of the upper and lower layers, respectively, were 20 percent (w/w) and 3 percent (w/w). The upper water-rich layer represented only 3 percent of the volume of the solvents used. The extruded filaments of cellulosic fibers were dried in the lower layer illustrating that only a portion of the bath was required for the actual drying step.

EXAMPLE 3

An arrangement corresponding to FIG. 1 was assembled in a beaker as in Example 1. The total weight of the butanol-water solution after preparation was 150 grams. After assembling this solvent-drying system, phosphorylated pulp extrudate prepared in a manner similar to that of Example 2 and containing 94 percent water (w/w) was extrusion formed on a wire mesh and dried in the upper layer of the solvent-drying system. It was then removed from the solvent bath and the remaining solvent evaporated off in a hot air stream from a laboratory-type Sargent-Welch electric forced air dryer at a temperature of about 115°C measured about 8 to 10 inches from the dryer.

The result was a soft, white web sample weighing 0.11 grams. To illustrate the effect of long term drying of material in the solvent-system, 50 grams of water were added to the system and allowed to come to equilibrium for 2 minutes. Following this, another extrusion formed sample of the same phosphorylated pulp extrudate was dried in the upper layer of the solvent system yielding a soft white sample similar in quality to the first sample, showing that the solvent system still was an effective drying medium.

The solvent system was then placed in a separatory funnel and the lower layer separated off. The lower layer, approximately 100 milliliters in volume, was then placed in a laboratory distillation apparatus, and distillation of the liquid was carried out until the distillation temperature rose to the boiling point of water (approximately 100°C) at which time distillation was terminated.

Condensate in an amount of 33.5 grams had been collected during the distillation and was returned to the beaker along with the upper layer from the separatory funnel. Another extrusion-formed phosphorylated pulp sample was dried in the upper layer yielding a soft, white, dry web of comparable quality to the samples described above and weighing 0.07 gram, showing that the solvent system utilizing the recycled condensate from the distillation still was an effective drying medium. Following the drying of this last sample, the solvent mixture from the drying bath was weighed and found to be 123 grams.

The liquid remaining in the distillation flask was also weighed and found to be 68 grams. The liquid was assumed to be pure water after it was shown that the liquid had no alcohol odor, and did not decolorize hot aqueous $KMnO_4$ solution or cause the color change of hot aqueous $K_2Cr_2O_7$ solution characteristics of alcohols and specifically butanol.

Evaluation of the above data showed that a total of 204.6 grams of liquid had been added to the mixture during the experiment as follows:

150 grams original drying mixture
50 grams water to simulate long term use 4.6 grams water in the gel dried for the web samples.

After the conclusion of the experiment, 123 grams of liquid was left in the drying bath and 68 grams of water had been removed in recycling the lower layer for a total of 191 grams. Thus, all but 12 grams of the liquid was accounted for, with the loss probably due to carryout with the dried web before final hot-air evaporation and in adherence to the walls of the various vessels used in carrying out the experiment.

EXAMPLE 4

This example demonstrates the advantages obtained through the use of controlled temperature conditions. As illustrated in FIG. 3, the apparatus for this example included a bath with heating and stirring means, a cooler for bath effluent, peristaltic pumping means (Masterflex Model No. 7015), separator, and means for heating solvent and returning it to the bath. As in FIGS. 1 and 2 means were also provided for handling the web.

In operation, the drying bath was charged with 2000 milliliters of n-butanol and the separator with 150 milliliters of n-butanol. A phosphorylated pulp web as in Example 2 was dried, and then 400 milliliters water were added to the drying bath to saturate the solvent with water at room temperature while maintaining a single layer.

The pumps were started to initiate circulation, and heat was applied to the bath. At a bath temperature of 35°C and separator contents temperature of 22°C ($\Delta T$ = 13°C) a single layer was maintained in both the drying bath and the separator. An additional 100 milliliters water were added to the drying bath. With a pumping rate of 20 milliliters per minute, a single layer was maintained in the drying bath while two distinct layers formed and were separated in the separator. After one-half hour of continuous circulation the drying bath temperature had risen gradually to 44°C and the temperature in the separator had dropped to 19°C ($\Delta T$ = 25°C). At this point a second web sample was dried successfully utilizing the bath.

An additional 100 milliliters water were added to the drying bath, and after only a momentary existence of two layers in the bath, the bath took the form of a single layer again while two distinct layers continued to separate out in the separator. After 1 hour from drying the previous sample, a third similar web sample was successfully dried using the bath. The solutions were then allowed to equilibrate at room temperature.

After drying the third web all of the solution used could be accounted for except for 410 grams which were lost during the 3 hours by evaporation, carryout on the web samples, and adherence to the containers. The remaining solution included 31 milliliters as a water-rich lower layer, and the rest formed the butanol-rich upper layer.

This example illustrates that selection of operating conditions resulting in an appropriate $\Delta T$ between the solvent drying bath and the separator will allow drying to take place in a single-layer solvent bath while separation of the solvent takes place at the lower temperature in a separate container. In general, the upper temperature is that at which the liquid being removed, in this case water, is removed most efficiently without boiling while the lower temperature may be as low as can be attained, without freezing the liquid being removed, for improved separation. Depending on factors such as heating and cooling costs, the $\Delta T$ may range from about 10C° and preferably is at least about 25C° for improved results. The drying and separation steps are thus greatly facilitated.

The previous examples demonstrate that the use of this method allows purification and recycling of the drying solvents while handling a minor fraction of the solvents used in the drying process. The resulting dried product was characteristic of the solvent-dried materials in terms of softness, color, absorbency, and other physical properties as described in the above-mentioned Lassen application.

In further illustration of the present invention, the butanol-water system will be described in terms of a numerical theoretical example with reference to FIG. 1. Assuming at A, a wet web 10 mass of 50,000 grams composed of 2,000 grams fiber and 48,000 grams water, i.e. consistency 96 percent, and utilizing published azeotropic data, the upper layer 16 will maintain a concentration of 79.9 percent butanol and 20.1 percent water with the bottom layer 18 maintaining a concentration of 7.7 percent butanol and 92.3 water based on partition coefficients as described, for example, in "Handbook of Chemistry and Physics", R. C. West, Ed., 48th edition, The Chemical Rubber Co., Cleveland, Ohio, 1967, p. D5. Changes in total bath concentration resulting from drying of the web will be accomodated by variations in relative volumes of the upper layer 16 and bottom layer 18. Further assuming a 9 to 1 carry-out, the solvent-dry web at B will have a mass of 20,000 grams composed of 2,000 grams fiber and 18,000 grams of layer 16 composition including 14,382 grams of butanol and 3,618 grams of water. The draw-off from bottom layer 18 at C will have layer 18 composition and a mass of 51,531.4 grams including 3,967.9 grams of butanol and 47,563.5 grams of water. By distilling the azeotrope until the butanol is depleted, 44,382 grams of water will be discarded at D and a product obtained at E of 3,967.2 grams butanol and 3,181.5 grams water for a concentration of 55.5 percent butanol and 44.5 percent water. After condensing at condenser 26, this product will be returned to the bath. While those calculations assume efficiencies of 100 percent, except for recovery of vapors from the air dryer, they demonstrate that, to remove the 48,000 g. of water, only 51,531.4 g. of the water rich layer need be treated and no recycling of the solvent-rich layer is necessary. If the air dryer vapors are returned to condenser 26, again assuming 100 percent efficiency, corresponding numbers at C are 55,732 grams total including 4,291.4 grams butanol and 51,440.6 grams water; at D, 48,000 grams water; at E, 4,291.4 grams bultanol and 3,440.6 grams water; and at F, 25,732 grams will be recycled including 18,673.4 grams butanol and 7,058.6 grams water to be returned to the bath with the condensed stream at E.

It will be apparent to those skilled in the art that the process of the present invention is useful for drying a wide variety of materials with a great number of multiple-layer azeotrope producing solvent systems. Thus, wherever the quantity of liquid to be removed is sufficient to make solvent renewal advantageous, the benefits of the present invention can be used to simplify and reduce the cost of solvent renewal. Specifically, examples of other solvent-drying processes which can be improved in accordance with this invention include pulp, gelable starches, fabrics, staple fibers, water-formed nonwovens and wool. These examples are representative only and are not to be considered as limiting the present invention.

To obtain maximum benefits, the solvent drying system should be chosen so that the concentration of the solvent in the liquid-rich layer is as low as practical. Specifically, the liquid content of the solvent-rich layer should be lower than the liquid content of the azeotrope for the respective drying system. Conversely, the liquid concentration of the liquid-rich layer should be greater than the liquid content of this azeotrope.

Thus, it is apparent that there has been provided, in accordance with the invention, a solvent-drying process that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A method of drying a wetted material comprising the steps of:

forming a solvent medium bath comprising an azeotropic mixed solvent system which forms a plurality of layers, said system having a coefficient of partition favoring the concentration of the liquid being removed in one of the layers and wherein at least one of the other layers maintain a concentration of the liquid being removed sufficiently low to produce the desired degree of drying;

contacting the wetted material with a layer maintaining a low concentration of the liquid being removed;

separating the material from the bath; and removing from the material solvent carried out from the bath.

2. The method of claim 1 including the steps of circulating a portion of the bath contents to a separator for separation of the liquid being removed from the solvent and maintaining a temperature differential of at least 10C° between the contents of the bath and the contents of the separator sufficient to substantially prevent a second layer from forming in the drying bath.

3. The method of claim 1 wherein the solvent medium is selected from the group consisting of a. butanol-water;

b. methanol-chloroform-water; and c. 2,3-dichloropropanol-water.

4. The method of claim 1 wherein separate layers are formed in the bath and the materials being dried does not contact the liquid-rich layer.

5. The method of claim 1 wherein the liquid-rich layer comprises a minor portion of the solvent medium.

6. The method of claim 1 including the additional step of purifying the liquid-rich layer by azeotropic distillation.

7. In a method of drying a wetted material by solvent exchange including the steps of providing a solvent bath, contacting the wetted material with the solvent bath, and removing the material, the improvement wherein the solvent bath includes a mixture of solvents partitioned into a plurality of immiscible layers, including a layer tending to maintain a concentration rich in the liquid being removed and wherein the material does not contact the liquid-rich layer.

* * * * *

UNITED STATES PATENT AND TRADEMARK OFFICE

CERTIFICATE OF CORRECTION

PATENT NO. : 3,982,325

DATED : September 28, 1976

INVENTOR(S) : Wayne C. Sigl/Frederick O. Lassen

It is certified that error appears in the above-identified patent and that said Letters Patent are hereby corrected as shown below:

Column 1, line 55, "renewed" should read -- removed --.

Column 2, line 53, "the" should be deleted.

Column 3, line 2, "similar" should read -- smaller --.

Column 3, line 58, "wheren" should read --wherein --.

Column 6, line 64, --percent -- should be added after "92.3".

Column 7, line 17, "those" should read -- these --.

Column 7, line 27, "bultanol" should read --butanol --.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademark*